US007622721B2

(12) United States Patent
Gutkin et al.

(10) Patent No.: US 7,622,721 B2
(45) Date of Patent: Nov. 24, 2009

(54) FOCUSED ANODE LAYER ION SOURCE WITH CONVERGING AND CHARGE COMPENSATED BEAM (FALCON)

(75) Inventors: Michael Gutkin, 5033 Dantes View Dr., Calabasas, CA (US) 91301; Alexander Bizyukov, Kharkov (UA); Vladimir Sleptsov, Moscow (RU); Ivan Bizyukov, Kharkov (UA); Konstantin Sereda, Kharkov (UA)

(73) Assignee: Michael Gutkin, Calabasas, CA (US)

( * ) Notice: Subject to any disclaimer, the term of this patent is extended or adjusted under 35 U.S.C. 154(b) by 245 days.

(21) Appl. No.: 11/704,476

(22) Filed: Feb. 9, 2007

(65) Prior Publication Data

US 2008/0191629 A1 Aug. 14, 2008

(51) Int. Cl.
*H01J 27/02* (2006.01)
*G21K 1/00* (2006.01)

(52) U.S. Cl. ..... 250/423 R; 250/424; 250/396 R; 250/396 ML; 315/111.01; 315/111.21; 315/111.31; 315/111.41; 315/111.81; 313/359.1; 313/360.1; 313/361.1; 313/362.1; 313/363.1

(58) Field of Classification Search ..... 250/396 R, 250/423 R, 424, 425, 426, 396 ML, 492.1, 250/492.3, 493.1; 315/111.61, 111.01, 111.21, 315/11.31, 111.41, 111.81, 111.91; 60/202; 313/231.31, 62, 359.1, 360.1, 361.1, 362.1, 313/363.1, 230; 361/230
See application file for complete search history.

(56) References Cited

U.S. PATENT DOCUMENTS 4,122,347 A 10/1978 Kovalsky et al.
4,277,304 A 7/1981 Horiike et al.
4,886,969 A * 12/1989 Knauer ..... 250/427
5,359,258 A 10/1994 Arkhipov et al.
5,716,500 A * 2/1998 Bardos et al. ..... 204/192.12
5,763,989 A 6/1998 Kaufman
5,798,602 A 8/1998 Gopanchuk et al.
5,838,120 A 11/1998 Semenkin et al.
5,945,781 A 8/1999 Valentian
5,973,447 A 10/1999 Mahoney et al.
6,002,208 A 12/1999 Maishev et al.
6,037,717 A 3/2000 Maishev et al.
6,130,507 A 10/2000 Maishev et al.
6,150,764 A 11/2000 Hruby et al.
6,208,080 B1 3/2001 King et al.
6,246,059 B1 * 6/2001 Maishev et al. ..... 250/426
6,525,480 B1 2/2003 Hargus et al.
6,664,739 B1 12/2003 Kishinevsky et al.

(Continued)

OTHER PUBLICATIONS

H.R. Kaufman et al., "End-Hall Ion Source", Jul./Aug. 1987, pp. 2081-2084.

(Continued)

*Primary Examiner*—Jack I Berman
*Assistant Examiner*—Nicole Ippolito Rausch

(57) ABSTRACT

A focused ion source based on a Hall thruster with closed loop electron drift and a narrow acceleration zone is disclosed. The ion source of the invention has an ion focusing system consisting of two parts. The first part is a ballistic focusing system in which the aperture through which the beam exits the discharge channel is tilted. The second is a magnetic focusing system which focuses the ion beam exiting the discharge channel by canceling a divergent magnetic field present at the aperture through which the beam exits the discharge channel. The ion source of the invention also has an in-line hollow cathode capable of forming a self-sustaining discharge. The invention further reduces substrate contamination, while increasing the processing rate. Further the configuration disclosed allows the ion source to operate at lower operational gas pressures.

14 Claims, 6 Drawing Sheets

U.S. PATENT DOCUMENTS

| | | | | |
|---|---|---|---|---|
| 6,919,672 | B2 | 7/2005 | Madocks | |
| 6,919,690 | B2 | 7/2005 | Siegfried et al. | |
| 6,984,942 | B2 | 1/2006 | Siegfried et al. | |
| 6,987,364 | B2 | 1/2006 | Petrmichl | |
| 2002/0036461 | A1* | 3/2002 | Schoenbach et al. | 313/495 |
| 2005/0126487 | A1* | 6/2005 | Tabuchi et al. | 118/723 E |
| 2006/0205190 | A1* | 9/2006 | Chi et al. | 438/507 |
| 2008/0073557 | A1* | 3/2008 | German et al. | 250/424 |

OTHER PUBLICATIONS

Advanced Energy Industries, Inc., "Round and Linear Ion Beam Sources", 2000.

A. Shabalin Whitepaper: Industrial Ion Sources and Their Application for DLC Coating, SVC 42nd Annual Technical Conference, Jan. 2001, pp. 1-4, Fort Collins, CO.

J. E. Keem "High Current Density Anode Layer Ion Sources" *44th Annual Techn. Conf. Soc. Vacuum Coaters*. Philadelphia, PA: SVC, 2001, 388-393.

A. Anders "Plasma and Ion Sources in Large Area Coatings" Review Lawrence Berkeley National Laboratory (University of California) 2005 pp. 1-11.

H.R. Kaufman et al., "End-Hall Ion Source", Journal of Vacuum Science & Technology A: Vacuum, Surfaces, and Films Jul./Aug. 1987 vol. 5, Issue 4, pp. 2081-2084.

* cited by examiner

FOCUSED ANODE LAYER ION SOURCE WITH CONVERGING AND CHARGE COMPENSATED BEAM (FALCON)

FIELD OF THE INVENTION

This invention relates to plasma technology and, more particularly, to ion beam sources/thrusters based on a plasma accelerator with closed-loop electron drift and a narrow zone of acceleration. More particularly, it includes embodiments that extend the efficiency of the aforementioned devices, by increasing the ion beam power density per unit area and suppressing contamination of the treated articles (substrates).

BACKGROUND OF THE INVENTION

An ion source is a device producing a beam of charged particles (heavier than electrons) suitable for transport to an experimental setup or to an application, such as accelerator injection, ion implantation, fusion driving, or ion propulsion. The critical element is formation of a beam, rather than simply plasma generation. The ion beam may be used for various purposes in thin film technologies, including but not limited to cleaning substrates, surface activation, polishing, etching, direct deposition of thin films, and ion beam sputter depositions utilizing various targets.

Though different types of ion sources exist, thin film technologies most commonly utilize ion sources with grids or closed electron drift.

Closed electron drift sources consist of three subgroups: 1. stationary plasma thrusters (SPT); 2. plasma accelerators with closed electron drift and a narrow acceleration zone (anode layer thrusters); and 3. end hall ion sources. (see e.g. U.S. Pat. No. 4,862,032, filed on Oct. 20, 1986).

Since their discovery, plasma accelerators with a closed electron drift and a narrow acceleration zone have been the basis for a wide variety of ion sources, named anode layer accelerators.

Devices utilizing plasma accelerators with closed electron drift and a narrow acceleration zone can be used for thin film technology and plasma chemistry. These sources are capable of generating ion beams with different configurations, shaped, for example, as rings and ellipses. They can be used for ion treatment of metal and nonmetal targets, as well as cleaning, etching and activation of surfaces. In addition, they can process materials without an additional electron emitter, although in the case of nonconductive and dielectric targets, under compensation of the ion beam by electrons results in a positive charge at the surface. The positive charge at the surface repels the incoming ion beam and thus reduces the efficiency of ion treatment.

FIG. 4 is a cross sectional view of a plasma accelerator having a closed electron drift and a narrow acceleration zone, the ion source 400 comprises a magneto-conductive housing 402 acting as a cold cathode. The ion source contains a circumferentially closed discharge channel 404, for ionization and acceleration of the operational gas. The discharge channel is formed by the inner walls of the magneto-conductive housing 402 and the circumferentially closed anode 406, which is placed coaxially inside the magneto conductive housing 402 and positioned along the discharge channel 404 for the formation of the plasma discharge space. The ion source 400 also contains means for the establishment of a magnetic field 408 in the azimuthally-closed channel (discharge channel). The discharge channel and anode are arranged within the magnetically conductive housing symmetrically with respect to the ion-emitting slit/aperture 410.

The ion source emits an ion beam 412, through the ion-emitting slit/aperture 410. The emitted ion beam may be directed onto a substrate 414.

The strong magnetic field traps electrons in the discharge channel 404, but the electrons oscillate and drift in the direction perpendicular to the E×B plane in the presence of magnetic (B) and electric field (E). In other words, the electrons are induced to drift circumferentially in the discharge channel 404. Drifting electrons repeatedly collide with the operational gas atoms delivered into the discharge channel 404, thus creating ion flux that is accelerated outward through the ion-emitting slit/aperture 410 of the discharge channel 404 due to the strong electrical field between anode 406 and cathode 402.

The size of these ion sources can be easily scaled from centimeters to meters in length and configured in various emission shapes. Due to their simplicity and robustness these ion sources, as described above, have become popular for large area web and glass treatment. However, there are problems with the current design of these ion sources, which prevent their wide acceptance for use in thin film technology. During treatment of the dielectric substrates these sources may produce magnetron style discharge outside of the source (frequently this discharge is explained as a diffuse mode of operation of the ion source). This same effect may occur at higher operational pressures. This discharge will sputter cathode material and contaminate the treated articles. As discussed above, the main reasons for the creation of the magnetron discharge and subsequent erosion of the pole pieces of the cathode and contamination of the treated articles (substrates) is a higher process pressure and/or uncompensated charge of the substrates. This phenomena is explained in the paper "Autocompensation of an ion beam in an accelerator with an anode sheath" Bizyukov, A at.el Published in Technical Physics Letters, Volume 23, Number 5, May 1997, pp. 403-404(2). Publisher: MAIK Nauka Interperiodical For many applications, the above described contamination is unacceptable. Thus, there are a number of designs directed towards reducing contamination of the treated parts.

For example U.S. Patent Publication No 20050040031, published Aug. 16, 2004, describes reducing the amount of substrate contamination by using a shield configuration that blocks the contaminants from impinging the substrate after the substrate passes through the etching beam while the substrate is moving in front of the ion source. This approach will reduce but not eliminate contamination resulting from a dynamic mode, i.e. the substrate moving in relation to the ion source. This approach is not applicable for the process in a static mode, i.e. when the substrate and ion source are not moving relative to each other.

Another example is U.S. Pat. No. 6,664,739, filed on Jun. 22, 2002, which describes reducing erosion of the component parts of the ion source. This is achieved by coating the cathode surfaces with material that, during operation of the source, will form a material that will increase electron emission. This invention claims only to reduce contamination but not to eliminate it to the point where it is possible to work with all substrates.

There are additional inventions that attempt to reduce contamination and increase ion beam effectiveness by optimizing the magnetic field of the ion source. U.S. Pat. No. 6,919,672 filed on Apr. 10, 2003 and U.S. Pat. No. 6,864,486 dated Mar. 8, 2005 are some of the examples of this approach. These inventions are, in general, related to the optimization of the magnetic field and the pole pieces of the ion source.

FIGS. 5 and 6 show top down views of differently shaped ion sources. FIG. 5 depicts a circular ion source and FIG. 6 depicts an elliptical ion source. The ion source has slits 502 and 602 respectively, through which the ion beam exits the ion source.

The current invention is an improvement of ion sources based on the plasma accelerator with closed electron drift and a narrow acceleration zone, also commonly referred as Anode Layer Ion Sources.

BRIEF SUMMARY OF THE INVENTION

An ion source comprising a plasma accelerator with a closed electron drift and a narrow zone of acceleration, having an azimuthally closed discharge channel that extends continuously about a main axis is disclosed. The discharge channel has a top and bottom end and a slit at the top end of the discharge channel, where the slit extends continuously about the main axis, and is tilted at an angle greater than zero and less than 90° relative to the main axis. In one embodiment the angle is in the range of about 10-45°. In one embodiment the device further contains a magnetic lens configured to magnetically focus the ion beam exiting the discharge channel, where the magnetic lens is positioned outside the discharge channel along the slit.

In one embodiment, the device further contains a self sustaining hollow cathode positioned outside the magnetic lens on a side of the magnetic lens opposite the discharge channel, where the hollow cathode is configured to allow the ion beam to pass, and allow for the formation of a self sustaining plasma within the hollow cathode in the presence of both the ion beam and a positive potential at a surface of a substrate being treated by the ion beam. In one embodiment, the hollow cathode is configured such that the self sustaining plasma counteracts the positive potential formed at a surface of a substrate being treated by the ion beam. In one embodiment a magnetic system is provided within the hollow cathode, where the magnetic system is configured to increase the intensity of the plasma formed inside the hollow cathode. The device contains an anode present within the discharge channel, where a voltage in the range of about 700-15000 volts is applied to the anode.

In one embodiment, the device contains a self sustaining hollow cathode located outside the discharge channel along the slit, where the hollow cathode is configured to allow the ion beam to pass, and where the hollow cathode is configured to form a self sustaining plasma within the hollow cathode in the presence of both the ion beam and a positive potential at a surface of a substrate being treated by the ion beam. The hollow cathode is configured such that the self sustaining plasma counteracts the positive potential formed at the surface of the substrate being treated by the ion beam. In one embodiment the hollow cathode further comprises a magnetic system within the hollow cathode, wherein the magnetic system is configured to increase the intensity of the plasma formed inside the hollow cathode.

In another embodiment, an ion source comprising a self sustaining hollow cathode is disclosed, where the hollow cathode is configured to allow the ion beam to pass, and where the hollow cathode is configured to form a self sustaining plasma within the hollow cathode in the presence of both the ion beam and a positive potential at a surface of a substrate being treated by the ion beam. The hollow cathode is configured such that the self sustaining plasma counteracts the positive potential formed at a surface of the substrate being treated by the ion beam. In one embodiment, a magnetic system is present within the hollow cathode, wherein the magnetic system is configured to increase the intensity of plasma formed inside the hollow cathode.

A method of focusing an ion beam generated in a plasma accelerator with a closed electron drift and a narrow zone of acceleration, having an azimuthally closed discharge channel which extends continuously about a main axis is disclosed. The discharge channel has a top and bottom end and has a slit providing an exit hole along the top end of the discharge channel, where the slit extends continuously about the main axis. The method comprises tilting the slit to an angle which is greater than zero and less than 90° relative to the main axis. In one embodiment, the angle is in the range of about 10-45°. In one embodiment, a magnetic lens is positioned outside the discharge channel along the slit and is used to magnetically focus the ion beam exiting the discharge channel.

In another embodiment, a method of neutralizing the effects of a positive potential formed at surface of a substrate to be treated is disclosed. The method comprises providing a self sustaining hollow cathode positioned between the ion beam source and the substrate where the hollow cathode is configured to allow the ion beam exiting the discharge channel or the magnetic lens to pass through the hollow cathode onto the substrate.

DETAILED DESCRIPTION OF THE INVENTION

The present invention is an ion beam source that produces an ion beam with high current and power density and charge and current compensated (neutralized) ion flux that allows for high efficiency and high rate ion beam processing of dielectric or electrically isolated products and conductive materials, while at the same time minimizing contamination of the substrate and reducing erosion of the cathodes (pole pieces).

Figure 1:
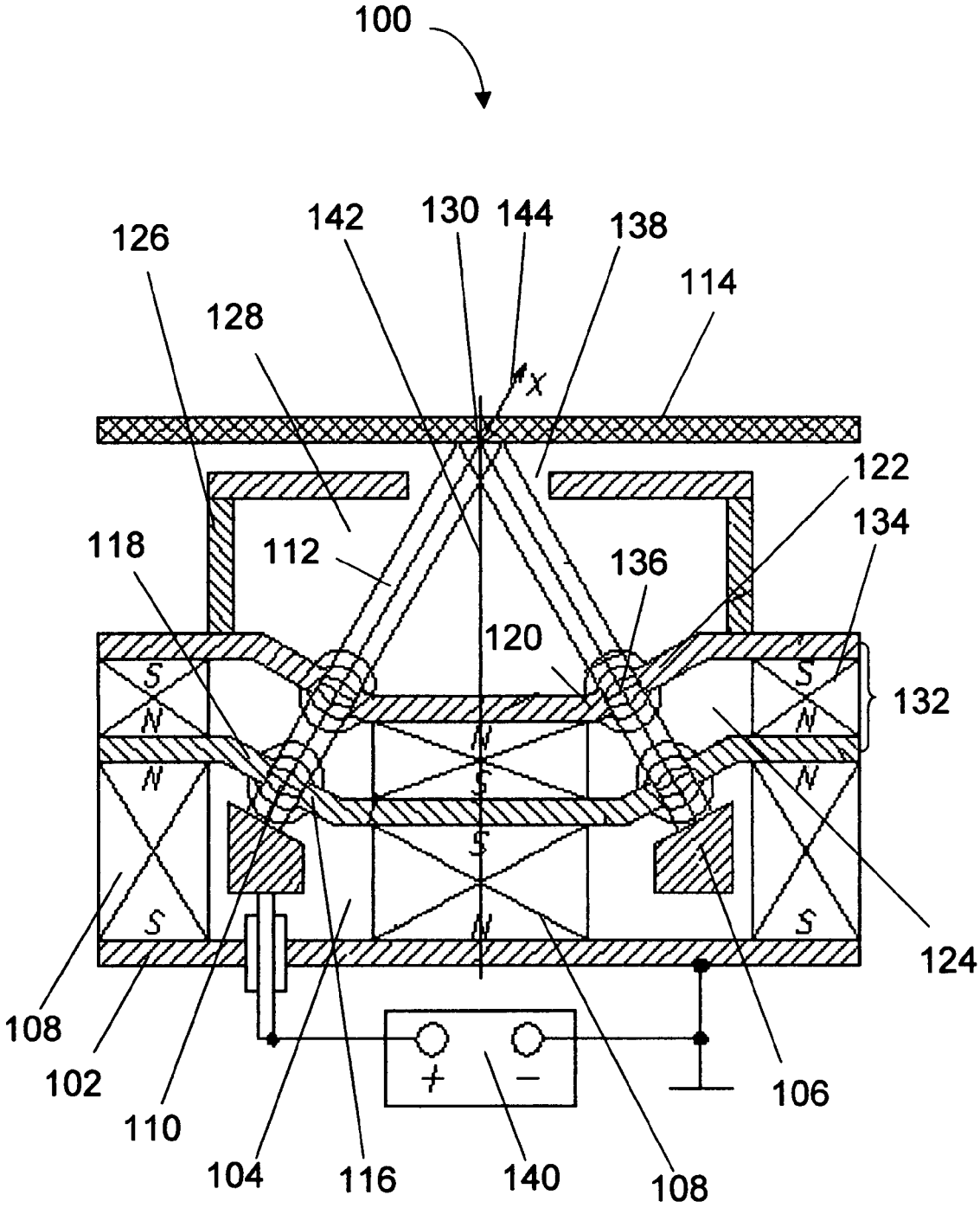
FIG. 1 is a is a cross-sectional view of an ion source of the invention

As shown in FIG. 1, the ion source 100 of the current invention is an ion source with a closed electron drift containing an azimuthally-closed channel (discharge channel) 104 for ionization and acceleration of the operational media, such as an ionizable gas. The channel 104 is formed by the inner walls of the magneto-conductive housing (cathode) 102 and azimuthally-closed anode 106 contained within the magneto-conductive housing 102. Plasma discharge is ignited in the cross-magnetic and electrical fields when voltage is applied between anode 106 and the cathode 102. A power supply 140 may be used to apply voltage between the cathode and anode. Discharge is ignited and is well sustained at an operational gas pressure in the range of about $1\times10^{-5}$-$5\times10^{-3}$ Torr and a discharge voltage of greater than about U=700 V on the anode. In one embodiment, the voltage on the anode is in the range of about U=700V to 15000V. The space of ionization and acceleration of the ions of the operational gasses is formed during operation of the ion source 100 in the discharge channel 102 at the outer surface of the anode. Nearly all of the voltage applied to the ion source is confined to this space with the thickness of $$l = \frac{\sqrt{\frac{2eU}{m}}}{\omega}\sqrt{\frac{\nu}{\nu^i}},$$

which generates an ion beam with an average energy in the range of about $\epsilon$=(0.3–0.4)eU. The direction of the velocity of the corresponding ion beam is along axis x 144.

The magneto conductive housing 102 forms inner 116 and outer 118 pole pieces that sandwich the ion-emitting slit/aperture 110 located at the top end of the discharge channel, through which the ion beam 112 is accelerated. The ion source 100 also contains a means for creation of a magnetic field 108 in the azimuthally-closed channel 102 of the magneto-conductive housing 102. The magnetic field inside of the discharge channel, established by magnetic means 108 and magnetic pole pieces 116 and 118, is in the range of about 1-3 KGs (Kilogauss). In addition, the magnetic pole pieces 116 and 118 are part of the cathode 102 of the ion source 100 and, along with the cathode 102, are at ground potential. The emitted ion beam may be directed onto a substrate 114.

As discussed above, the discharge channel 104 of the ion source 100 is surrounded by the magneto-conductive housing 102 that contains inner 116 and outer 118 magnetic pole pieces and an electrically isolated anode 106.

As discussed above, the distance L between the anode 106 and the internal part of the pole pieces 116 and 118 is designed based on the following relationship, $$L \le \sqrt{\frac{\frac{2eU}{m}}{\omega}}\sqrt{\frac{\nu}{\nu^i}},$$

where e and m are the charge and mass of the electron, U is the voltage generated by the power supply, $$\omega = \frac{eB}{mc}$$

is the electron cyclotron frequency, B is the mean magnetic field induction at the anode surface, c is the speed of light, and $$\frac{\nu}{\nu^i}$$

is the ratio of the total frequency of the collision between the electrons and atoms to the frequency of the ionization of the atoms by the electrons.

In order to focus the beam 112 onto a small spot on the surface of the substrate 114, the inner 116 and outer 118 magnetic poles and the ion-emitting slit/aperture 110 are tilted at angle in the range of about 10°-45° relative to the main axis 142 of the ion source.

This ballistic type of focusing, in the case of a circular ion source, forms an ion beam 112 having an emission surface unwrapped on a contour and provides a cone shaped beam 112 having a crossover point 130. This converged beam 112 forms a small spot at the crossover point, and may be aligned so that the crossover occurs at the surface of the substrate.

In addition to the tilt angle of the inner 116 and outer 118 pole pieces and the slit/aperture 110, the ion source 100 may be attached to a magnetic lens 132, positioned near the slit/aperture 110 of the ion source. The magnetic lens 132 can be used to further focus the ion beam 112. As the ion beam exits the discharge channel 104 it passes the inner 116 and outer 118 pole pieces where electrical field is practically absent, but there is a strong magnetic field $B_\perp$ that is perpendicular to the direction of the ion beam flux. (see e.g. FIG. 2) Thus, the ion beam experiences Lorenz's forces in the azimuthal direction. These forces increase the ion velocity in the azimuthal direction, and diverges the ion beam in the azimuthal direction. This leads to the defocusing of the beam and decreases the current density of the beam. To compensate for this effect (the azimuthal component of the ion velocity), the beam is directed into the magnetic lens 132 located near the slit/aperture 110 of the ion source 100. The magnetic lens 132 contains a means for establishing a magnetic field 134, inner 120 and outer 122 magnetic pole pieces, and a slit/aperture 136. The magnetic field of the magnetic lens 132 has a direction opposite to the magnetic vector inside the discharge channel 104 but it is located inside its own azimuthally closed channel 124 that is positioned coaxially relative to the discharge channel (see e.g. FIGS. 1 and 2.). When magnetic fluxes with directions perpendicular to the direction of the ion beam 112 are equal in value then the field established by the magnetic lens 132 together with the magnetic field established in the discharge channel 104 form a "reversive" focusing magnetic system for focusing and compression of the ion beam 112 and provides suppression of the azimuthal divergence of a beam exiting the discharge channel 104, thus increasing the current density of the ion beam 112. The magnetic lens 134 provides maximum magnetic focusing and minimizes the cross-section of the focused beam when $$\int_0^d B_\perp(x)\,dx = 0.$$

The combination of magnetic and ballistic focusing systems can achieve a beam having a current density in the range of about (20-500 mA/cm$^2$).

Figure 2:
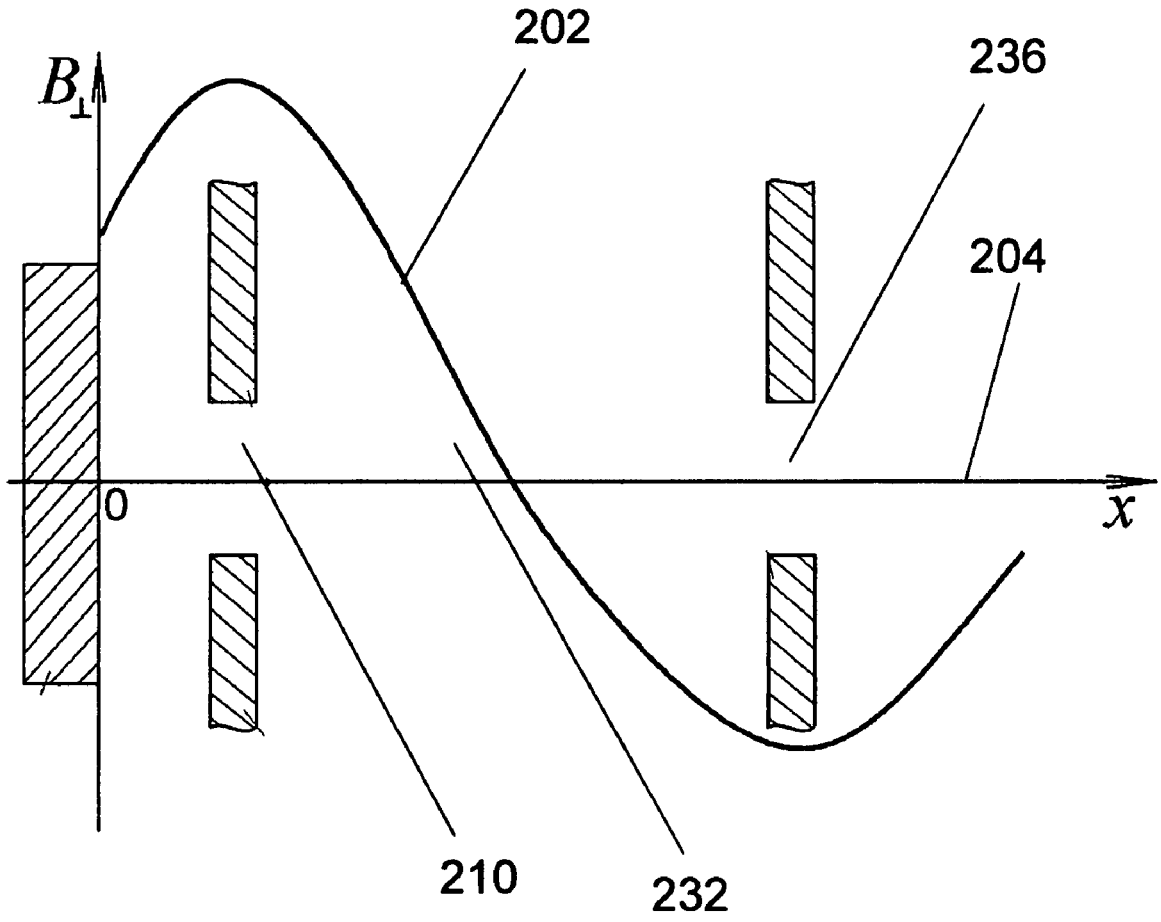
FIG. 2 depicts the distribution $B_{\perp}$ component of the magnetic induction that is perpendicular to the ion flux direction.

FIG. 2 depicts the profile of the magnetic field 202 perpendicular to the ion beam moving along the X-axis 204. The ion beam exits the discharge channel through slit/aperture 210, passes through the magnetic lens 232 and exits the magnetic lens 232 through slit/aperture 236. The magnetic field near the slit/aperture is opposite to the field near aperture 210, thus forming a "reversive" focusing magnetic system for the focusing and compression of the ion beam by suppressing azimuthal divergence of a beam exiting the discharge channel 104, and as a result increasing the current density of the ion beam 112.

When processing a substrate such as a dielectric or an electrically isolated surface, an ion beam 112, with incomplete ion beam charge compensation by electrons, positively charges the surface of the treated article. The electrical field of the positive potential on the surface can reach the level of the positive potential of the anode. An increase in the positive potential at the surface causes a reduction in the velocity of the ion beam 112, thus decreasing the efficiency of the ion beam treatment.

To overcome the problem associated with charging the substrate surface due to incomplete neutralization of the ion beam 112, the ion beam 112 is passed through a hollow cathode 126 comprising a metallic azimuthally enclosed cavity 128 with an aperture 138 for the exit of the ion beam.

The hollow cathode 126 works by enabling a small fraction of the ions from the ion beam 112 to collide with the atoms of a neutral gas present in the hollow cathode 126. These collisions ionize the atoms of the neutral gas leading to the generation of primary electrons inside the hollow cathode 126 and the generation of a primary plasma. As a result, a self-sustaining gas discharge is formed inside of the hollow cathode during treatment of the dielectric and electrically isolated articles, resulting in charge compensation of the ion beam. The gas discharge is self sustaining because an additional power supply is not required to induce the formation of the gas discharge in the hollow cathode. The potential difference between the hollow cathode and the substrate enables the formation of the gas discharge, as discussed below.

In general, the amount and energy of the electrons generated in the hollow cathode 126 are not sufficient to neutralize the ion beam charge and sustain a plasma. However, in the presence of an electrical field between the hollow cathode and the substrate, the primary electrons gain enough energy to further ionize the gas and thus generate secondary electrons. The secondary electrons then collide with additional neutral gas atoms, generating additional ions and electrons, creating an avalanche effect by repeating the cycle.

At the same time, the positive ions present in the primary plasma strike the inner surface of the hollow cathode, generating additional electrons. This ionization and electron generation results in an amplification of the number of electrons present in the hollow cathode until an intensive plasma discharge is reached. After formation of the primary plasma inside the hollow cathode, the electrical field distribution is not the same as it would have been in vacuum without the presence of plasma. A strong electrical field condensed to a narrow area adjacent to the internal surface of the hollow cathode forms, due to a plasma shielding effect. The electrons, present in the intensive discharge inside the hollow cathode, counteract the potential formed on the surface of the substrate.

The generated electrons oscillate multiple times in the cavity of the hollow cathode, colliding and ionizing gas, until they enter the opening of the hollow cathode and move toward the treated substrate. The hollow cathode is configured to retain the electrons for as long as possible, thus increasing their ability to ionize the gas.

Figure 3:
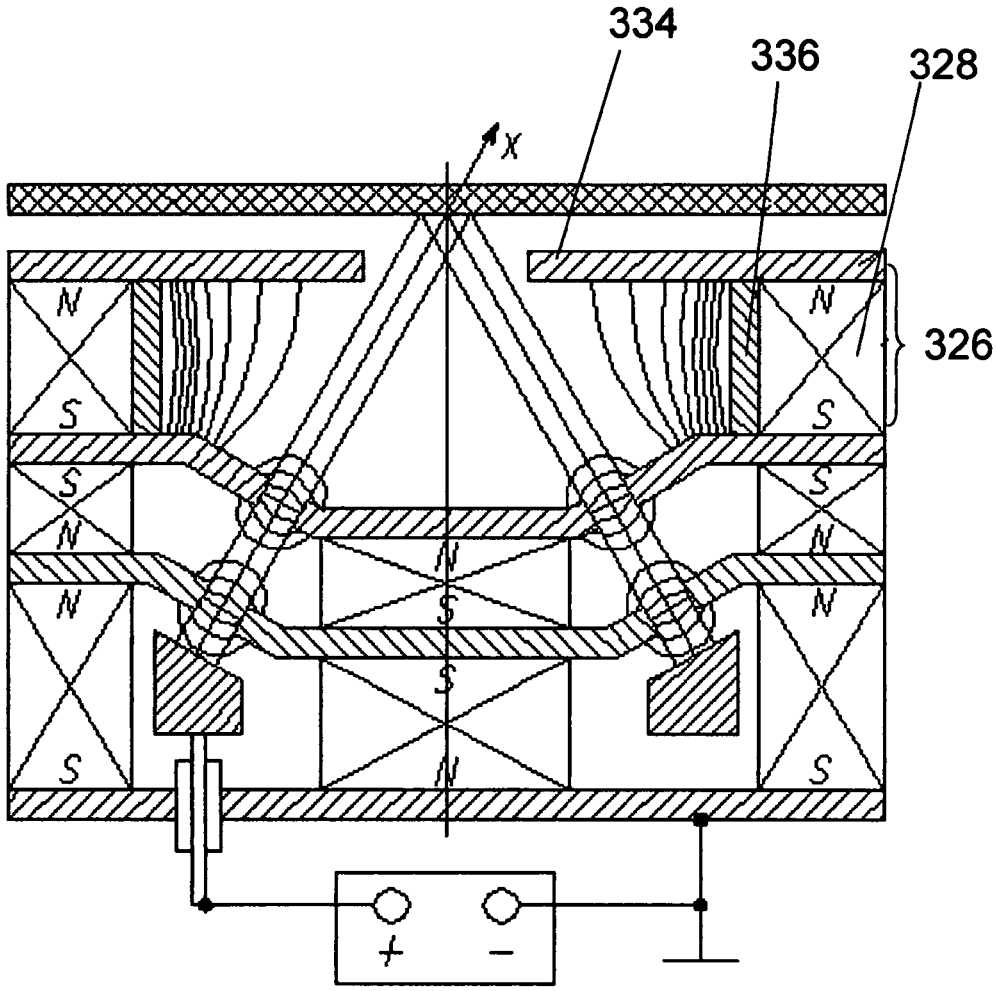
FIG. 3 is a cross-sectional view of an ion source of the invention with a hollow cathode of the magnetron type.
Figure 4:
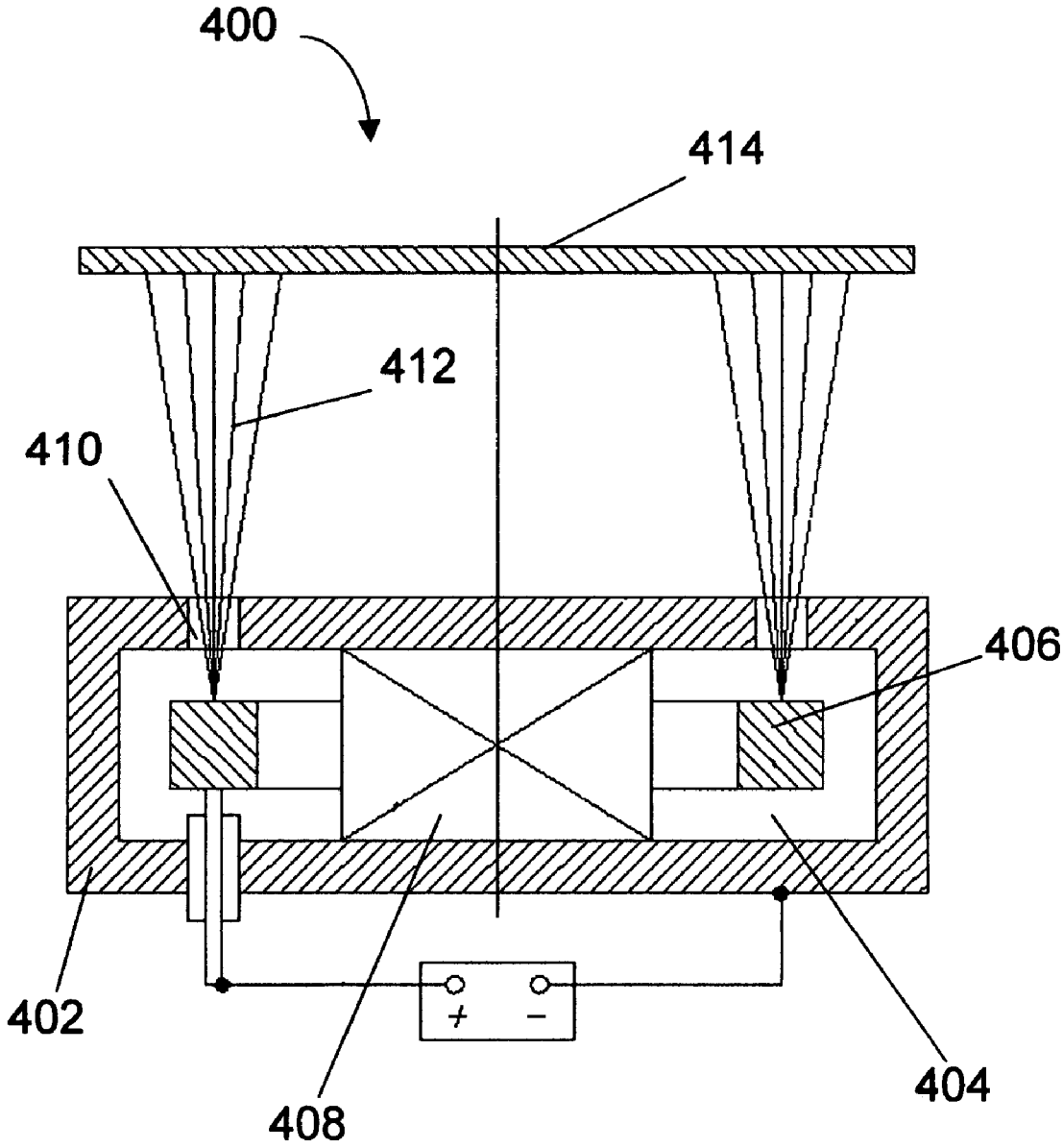
Fig. 4 (Background Art)
FIG. 4 is a cross-sectional view of an ion source described in the background section.
Figure 5:
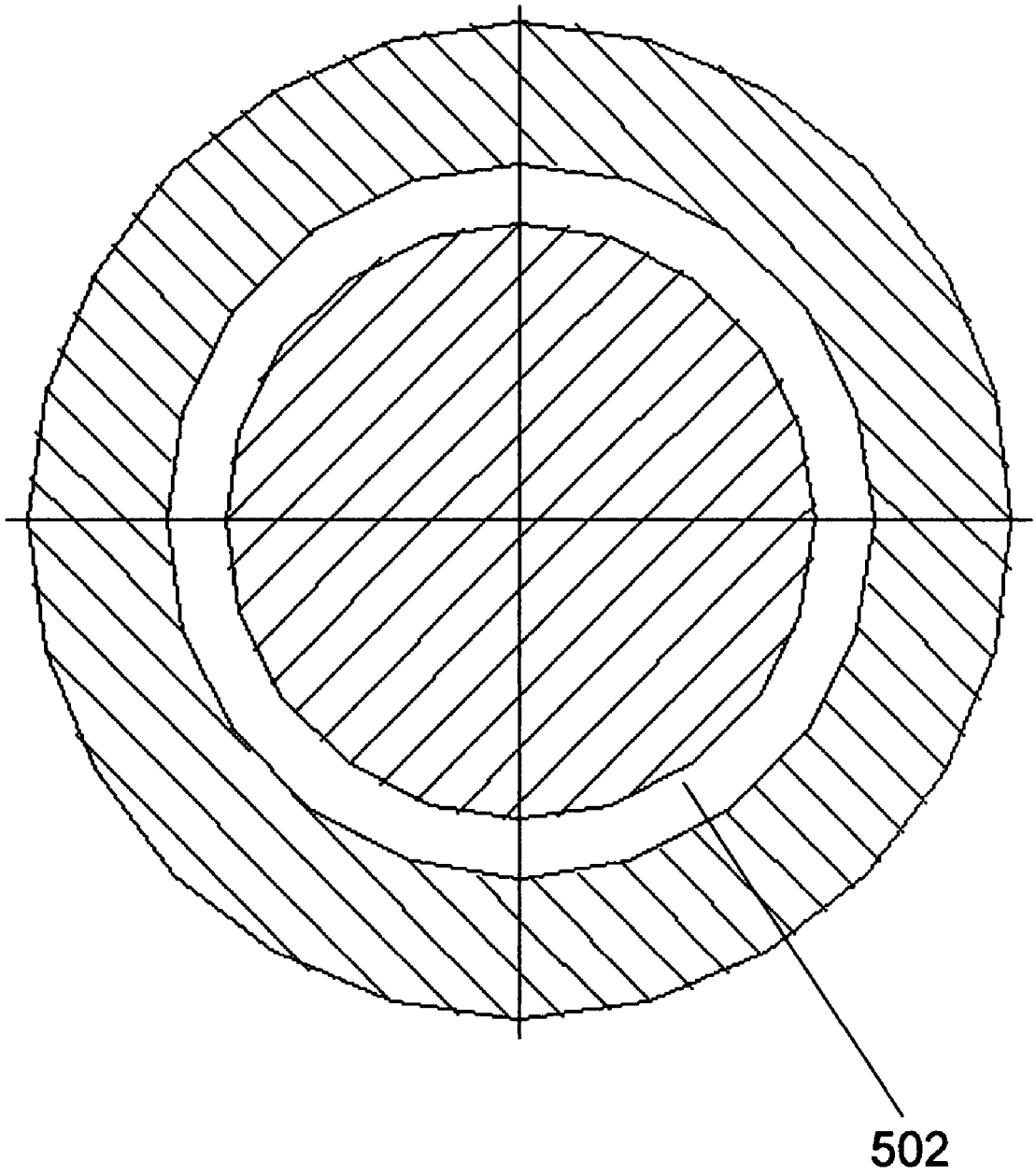
Fig. 5 (Background Art)
FIGS. 5 and 6 are top down views depicting different shapes of the ion source.
Figure 6:
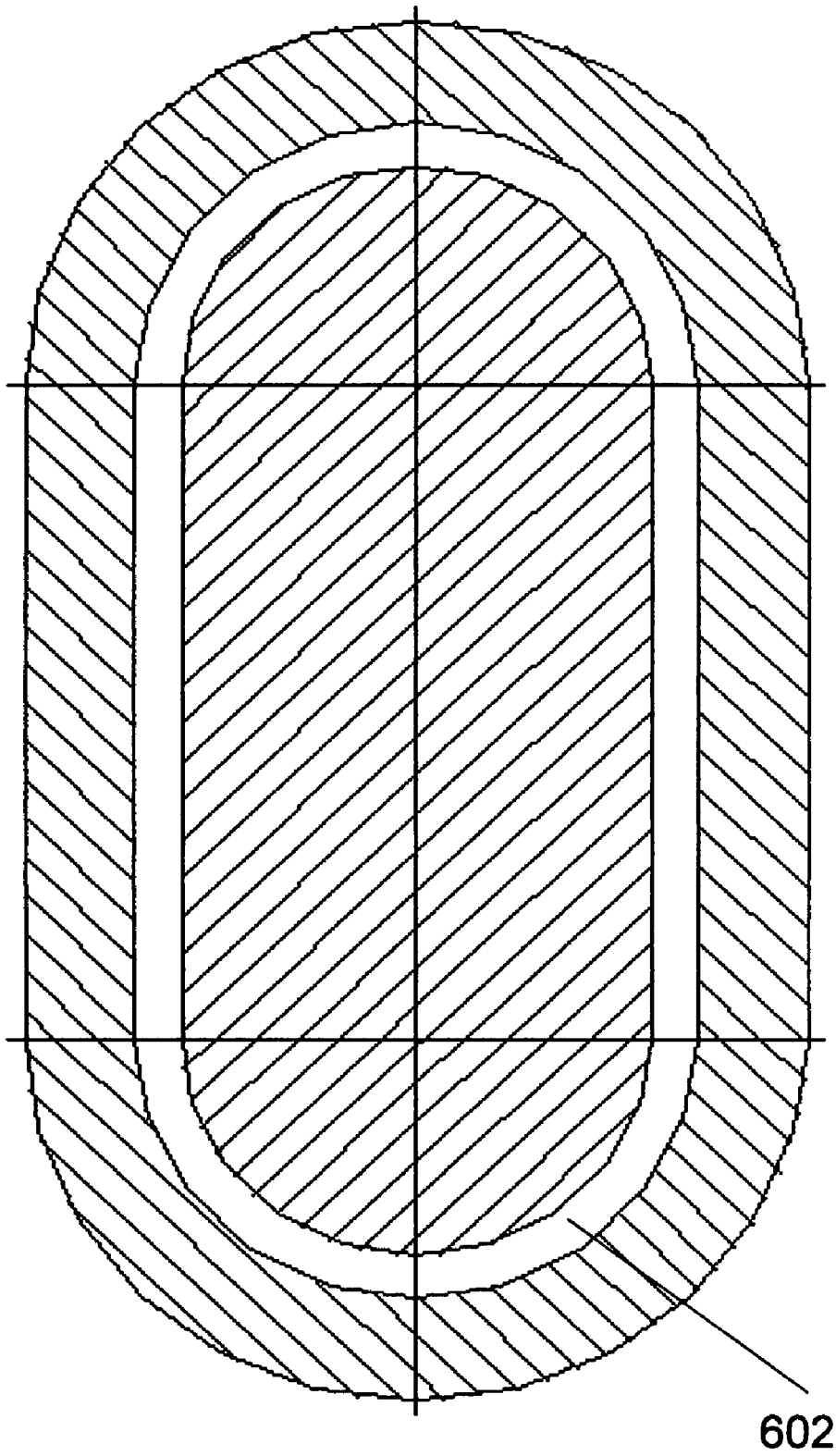
Fig. 6 (Background Art)

In one embodiment, as shown in FIG. 3, the hollow cathode 326 is supplied with its own magnetic system consisting of the magnets 328 and magnetic pole pieces 334. This configuration establishes a magnetic field of an arch configuration with maximum strength in the range of about 300-1000 Oersted on the internal surface of a cavity of the hollow cathode 326. The hollow cathode further contains non magnetic metals 336 that function as current collectors in the hollow cathode 326 (hollow cathode type magnetron). The presence of the magnetic systems enables enhanced retention of electrons and ions, thus increasing the density of the discharge in the hollow cathode 326 and the efficiency of neutralization of the potential formed on the surface of the substrate.

For substrate processing, the ion source 100 is positioned inside of a vacuum chamber. An operation gas is introduced into the ion source 100. Plasma discharge is ignited in the cross-magnetic and electrical fields when voltage is applied between anode 106 and cathode 102. The discharge is ignited and it is well sustained at a pressure of the operational gasses in the range of about $1\times10^{-5}$-$5\times10^{-3}$ Torr and a discharge voltage of greater than about U=700 V on the anode. In one embodiment the voltage on the anode is in the range of about U=700V to 15000V. The surface of the samples to be treated may be positioned in the focus or crossover point (smallest possible illumination spot for the converging beam) or near the focus or crossover point. One example of the positioning of the ion source 100 of the invention is shown in FIG. 1. The source is positioned inside of the vacuum chamber for ion beam processing samples. The surface of a sample being treated is positioned in or near the focus of the ion source. The cross section of a non limiting configuration of positioning a substrate relative to the ion source is shown FIG. 1.

EXAMPLE 1

An argon ion beam for the ion milling of an aluminum nitride (AlN) film was generated. The ion source had a round ion emitting aperture with an outside diameter of 30 mm. The operational gas was Ar at a pressure of $4.5\times10^{-5}$ Torr. The anode voltage was 3 KV, the discharge current was 27 mA. An ion beam was directed at the AlN film deposited on a Si wafer. The treated part was fixed relative to the ion source (static mode). The average ion milling rate of the AlN film was 3500 A/min. The outside diameter of the spot etched in the AlN film was 5 mm. Following 30 minutes of operation in static mode the AlN film was found to contain no contamination. The potential of the surface of the AlN film did not exceed 100 V, which corresponds to a less than 10% loss in beam energy and essentially no loss of the ions in the ion beam.

Although the invention has been shown in the form of specific embodiments, it is to be understood that the invention is not to be limited to the disclosed embodiments. The embodiments discussed above were given only as examples. Changes and modifications are possible and the invention is intended to cover various modifications and equivalent designs included within the scope of the invention.

What we claim:

1. An ion source comprising:

a plasma accelerator with a closed electron drift and a narrow zone of acceleration, having an azimuthally closed discharge channel that extends continuously about a main axis, wherein the discharge channel has a top and bottom end;

a slit at the top end of the discharge channel, wherein the slit extends continuously about the main axis, wherein the slit is tilted at an angle greater than zero and less than 90° relative to the main axis; and further comprising a magnetic lens configured to magnetically focus the ion beam exiting the discharge channel, wherein the magnetic lens is positioned outside the discharge channel along the slit.

2. The device according to claim 1, wherein the angle is in the range of about 10-45°.

3. The device according to claim 2 further comprising a self-sustaining hollow cathode positioned outside the magnetic lens on a side of the magnetic lens opposite the discharge channel, wherein the hollow cathode is configured to allow the ion beam to pass, and wherein the hollow cathode is configured to form a self-sustaining plasma within the hollow cathode in the presence of both the ion beam and a positive potential at a surface of a substrate being treated by the ion beam.

4. The device according to claim 3 wherein the hollow cathode is configured such that the self-sustaining plasma counteracts the positive potential formed at a surface of a substrate being treated by the ion beam.

5. The device according to claim 3, further comprising a magnetic system within the hollow cathode, wherein the magnetic system is configured to increase the intensity of the plasma formed inside the hollow cathode.

6. The device according to claim 1 further comprising an anode present within the discharge channel, wherein a voltage in the range of about 700-15000 volts is applied to the anode.

7. The device according to claim 1 further comprising a self-sustaining hollow cathode located outside the discharge channel along the slit, wherein the hollow cathode is configured to allow the ion beam to pass, and wherein the hollow cathode is configured to form a self-sustaining plasma within the hollow cathode in the presence of both the ion beam and a positive potential at a surface of a substrate being treated by the ion beam.

8. The device according to claim 7, wherein the hollow cathode is configured such that the self-sustaining plasma counteracts the positive potential formed at the surface of the substrate being treated by the ion beam.

9. The device according to claim 7, further comprising a magnetic system within the hollow cathode, wherein the magnetic system is configured to increase the intensity of the plasma formed inside the hollow cathode.

10. An ion sources comprising:

a self-sustaining hollow cathode, wherein the hollow cathode is configured to allow the ion beam to pass, and wherein the hollow cathode is configured to form a self-sustaining plasma within the hollow cathode in the presence of both the ion beam and a positive potential at a surface of a substrate being treated by the ion beam.

11. The ion source according to claim 10 wherein the hollow cathode is configured such that the self-sustaining plasma counteracts the positive potential formed at a surface of the substrate being treated by the ion beam.

12. The device according to claim 10, further comprising a magnetic system within the hollow cathode, wherein the magnetic system is configured to increase the intensity of plasma formed inside the hollow cathode.

13. A method of focusing an ion beam generated in a plasma accelerator with a closed electron drift and a narrow zone of acceleration, having an azimuthally closed discharge channel which extends continuously about a main axis, wherein the discharge channel has a top and bottom end and wherein the discharge channel has a slit providing an exit hole along the top end of the discharge channel, wherein the slit extends continuously about the main axis, the method comprising:

tilting the slit to an angle which is greater than zero and less than 90° relative to the main axis; and providing a magnetic lens positioned outside the discharge channel along the slit wherein the magnetic lens is configured to magnetically focus the ion beam exiting the discharge channel.

14. The method according to claim 13, wherein the angle is in the range of about 10-45°.

* * * * *